US007536879B2

(12) United States Patent
Vanwelden

(10) Patent No.: US 7,536,879 B2
(45) Date of Patent: May 26, 2009

(54) METHOD FOR KNITTING A DOUBLE JERSEY KNIT FABRIC ON A DOUBLE JACQUARD, DOUBLE JERSEY CIRCULAR KNITTING MACHINE AND DOUBLE JERSEY KNIT FABRIC KNITTED BY SUCH A METHOD

(75) Inventor: Johan Vanwelden, Wielsbeke (BE)

(73) Assignee: Lava bvba, Wielsbeke (BE)

( * ) Notice: Subject to any disclaimer, the term of this patent is extended or adjusted under 35 U.S.C. 154(b) by 0 days.

(21) Appl. No.: 12/072,531

(22) Filed: Feb. 27, 2008

(65) Prior Publication Data

US 2008/0236204 A1 Oct. 2, 2008

(30) Foreign Application Priority Data

Mar. 27, 2007 (EP) ..... 07105064

(51) Int. Cl.
*D04B 9/06* (2006.01)

(52) U.S. Cl. ..... 66/196; 66/19

(58) Field of Classification Search ..... 66/92, 66/93, 94, 8, 194
See application file for complete search history.

(56) References Cited

U.S. PATENT DOCUMENTS

| | | | | | |
|---|---|---|---|---|---|
| 3,986,374 | A | * | 10/1976 | Fane | 66/190 |
| 3,990,268 | A | * | 11/1976 | Smith | 66/92 |
| 4,353,229 | A | * | 10/1982 | Hutchinson et al. | 66/197 |
| 5,027,618 | A | * | 7/1991 | Robinson et al. | 66/202 |
| 5,887,451 | A | * | 3/1999 | Suzuki | 66/64 |

FOREIGN PATENT DOCUMENTS

| | | |
|---|---|---|
| DE | 2253005 | 5/1973 |
| EP | 0591987 | 7/1997 |
| EP | 0737767 | 1/2000 |
| EP | 0822280 | 6/2002 |
| FR | 2160131 | 6/1973 |

* cited by examiner

*Primary Examiner*—Danny Worrell
(74) *Attorney, Agent, or Firm*—James Creighton Wray; Meera P. Narasimhan

(57) ABSTRACT

The invention relates to a method for knitting a double jersey knit fabric (11) on a double jacquard, double jersey circular knitting machine, the double jersey knit fabric (11) having a design consisting of more than 12 needles, wherein the knitting machine comprises a cylinder (C) and a dial (D) provided with needles each separately driven by an electronical pattern controlling mechanism, wherein the needles of the cylinder (C) are provided for knitting the front (F) of the fabric (11), and the needles of the dial (D) are provided for knitting the back (B) of the fabric, and wherein the front (F) of the fabric (11) comprises at least one area of blister fabric (5), wherein a non-reversible single-sided designed knit fabric (11) is knitted having a desired design at the front of the fabric (11) and a technical design at the back of the fabric (11), wherein this technical design is created by knitting or tucking one or more of the yarns (7, 8, 9 and/or 10) that are used for forming the blister fabric (6) with at least one stitch (3) or tuck solely on the needles of the dial (D), missing at least one needle on the dial (D) before and/or after this at least one stitch (3) or tuck in the areas (16) where the one or more yarns (7, 8, 9 and/or 10) are not knitting or tucking the design in the front (F) of the fabric (11) on the needles of the cylinder (C). The invention further relates to a double jersey knit fabric (11) knitted by such a method.

15 Claims, 1 Drawing Sheet

Figure 1:
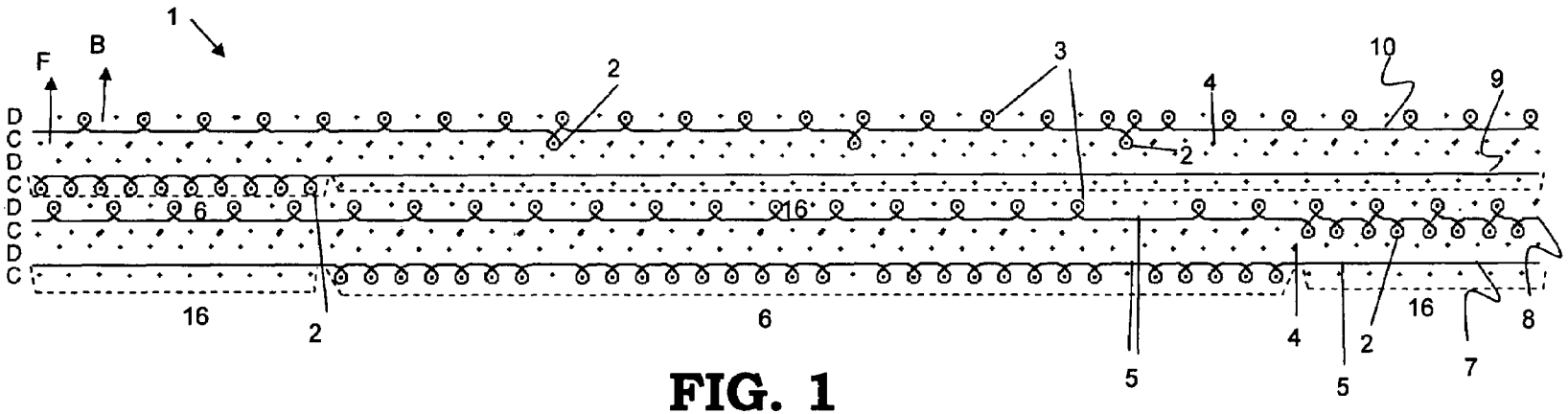

METHOD FOR KNITTING A DOUBLE JERSEY KNIT FABRIC ON A DOUBLE JACQUARD, DOUBLE JERSEY CIRCULAR KNITTING MACHINE AND DOUBLE JERSEY KNIT FABRIC KNITTED BY SUCH A METHOD

This application claims the benefit of European application No. 07105064.5 filed Mar. 27, 2007, which is hereby incorporated by reference by reference in its entirety.

The invention relates to a method for knitting a double jersey knit fabric on a double jacquard, double jersey circular knitting machine, the double jersey knit fabric having a design (also called pattern) consisting of more than 12 needles (consequently having a large design), wherein the knitting machine comprises a cylinder and a dial provided with needles each separately driven by an electronical pattern controlling mechanism (also called jacquard mechanism), wherein the needles of the cylinder are provided for knitting the front of the fabric, and the needles of the dial are provided for knitting the back of the fabric, and wherein the front of the fabric comprises at least one area of blister fabric (also called pocket fabric or single jersey fabric). The invention furthermore relates to a double jersey knit fabric knitted by such a method.

A double jersey knit fabric (also called a double jersey knit wear) is a classical knit fabric that is knitted on a circular knitting machine, whereby the circular knitting machine is provided with a cylinder and a dial (that is positioned just above the cylinder), each provided with needles, the needles of the cylinder being provided for knitting the front of the fabric, and the needles of the dial being provided for knitting the back of the fabric. Usually, but not mandatory, lay-in yarns are added in-between the dial and the cylinder in order to give volume to these double jersey knit wears, this for instance when it is used as mattress ticking.

In a single jacquard, double jersey circular knitting machine, the needles of the cylinder are driven by an electronical pattern mechanism, through which every single needle of the cylinder can be selected to either knit, miss or tuck, thereby creating the possibility to produce a design on the front of the fabric with different colours.

In these classical double jersey knit fabrics, the fabric is build up out of two or more colours comprising a main colour that only is produced on the cylinder in a blister fabric, and a second (or other) design colour that is knitted on the cylinder as well as on the dial and that forms a binding/liaison between the front and the back of the fabric.

The disadvantage of such a classical double jersey knit fabric is that the fabric feels less soft in the area of the design where there is a binding/liaison between the front and the back of the fabric. Consequently, a fabric with a lot of binding in the design in the same area should be avoided.

In order to solve this problem, another type of double jersey knit fabric is produced, wherein both the main colour of the fabric, as well as a second design colour, are knitted in a blister fabric in the front of the fabric, both resulting in a soft feeling, and a third, and possibly also other design colours, is/are still being knitted on both the dial and the cylinder in order to connect the front with the back of the fabric.

The disadvantage of this type of double jersey knit fabric is that, when knitting large designs consisting of more than 12 needles, the yarns that are used for knitting blister fabric on the cylinder are floating over long distances, and are consequently not controlled very well in these areas because these yarns are not knitted on the needles of the cylinder nor on the dial, through which these yarns can be visible through the other colour in the front of the fabric. When lay-in yarns are used as filler yarns between the front and the back fabric, then the yarns that are used for knitting the blister fabrics can be positioned just behind the lay-in yarns, or in front of the lay-in yarns having as a result that they can be seen through the other colour in the front of the fabric in an irregular way. In case of important colour differences between the main colour and the second colour that is also knitted in a blister fabric, this undesired "shining-through" aspect even becomes more elaborated with double jersey knit fabrics having large designs with floating yarns over large areas.

Another problem is that especially on the borders of the design (but not limited thereto) at the first or the last stitch(es) or tuck(s), small loops can be formed which can be easily pulled out further. This problem is also due to the fact that the yarns that are used for knitting the blister fabric in those areas when they are not being knitted on the needles of the cylinder are floating between the front and the back of the fabric. The yarns that are used for the background colour are usually (but not always) spun type yarns and consequently not smooth, rarely or not giving this problem. This problem however occurs especially when slick/smooth yarns of the filament type are used for the design.

A last problem is that the two adjacent blister fabrics of the front and the back of the fabric, i.e. the part in the main background colour and the part of one or more of the design colours, can be easily pulled open, also creating quality problems.

Beside single jacquard, double jersey circular knitting machines, also double jacquard, double jersey knitting machines are already known. Until now, these knitting machines are used for knitting reversible double-sided designed knit fabrics. It is however not clear in which way the abovementioned problems that arise when knitting double jersey knit fabrics having large designs consisting of more then 12 needles, wherein the front of the fabric has one or more areas of blister fabric, and wherein the one or more yarns that are used for forming these blister fabrics are floating over a large distance between the front and the back of the fabric in these large areas, when using such double jacquard, double jersey circular knitting machines can be solved.

The purpose of the invention is to provide a method for knitting a double jersey knit fabric on a double jacquard, double jersey circular knitting machine according to the preamble of claim 1, and a double jersey knit fabric knitted by such a method, wherein this double jersey knit fabric has a seriously reduced "shining-through" effect and undesired loop-forming, consequently having a high-quality.

This purpose is solved by providing a method for knitting a double jersey knit fabric on a double jacquard, double jersey circular knitting machine, the double jersey knit fabric having a design consisting of more than 12 needles, wherein the knitting machine comprises a cylinder and a dial provided with needles each separately driven by an electronical pattern controlling mechanism, wherein the needles of the cylinder are provided for knitting the front of the fabric, and the needles of the dial are provided for knitting the back of the fabric, and wherein the front of the fabric comprises at least one area of blister fabric, wherein a non-reversible single-sided designed knit fabric is knitted having a desired design at the front of the fabric and a technical design at the back of the fabric, wherein a non-reversible single-sided designed knit fabric is knitted having a desired design at the front of the fabric and a technical design at the back of the fabric, wherein this technical design is created by knitting or tucking one or more of the yarns that are used for forming the blister fabric with at least one stitch or tuck solely on the needles of the dial, missing at least one needle on the dial before and/or after this at least one stitch or tuck in the areas where the one or more yarns are not knitting or tucking the design in the front of the fabric on the needles of the cylinder.

By using this method, all problems as mentioned above are solved for the following reasons:

The problem of the "shining-through" effect of the floating yarns is solved because these floating yarns are knitted on the back of the fabric. Furthermore, because these floating yarns are knitted on the back of the fabric, when lay-in yarns are inserted between the front and the back of the fabric, the floating yarns are always behind the lay-in yarns. So even in case of an important colour difference, the "shining-through" effect is seriously reduced.

The problem of the undesired loop-forming of the floating yarns is solved because of the knitting of these floating yarns on the needles of the dial.

The problem of the loss of quality because of the two adjacent blister fabrics on the front and the back of the fabric is also solved as both blister fabrics are now also knitted on the needles of the dial on the back of the fabric, and thereby are connected to each other.

In a preferred method according to the invention, this technical design is created by knitting or tucking all yarns that are used for forming the blister fabric with at least one stitch or tuck solely on the dial, missing at least one needle on the dial before and/or after this at least one stitch or tuck in the areas where the one or more yarns are not knitting or tucking the design in the front of the fabric on the needles of the cylinder.

In a favourable method according to the invention this technical design is created by repetitively knitting or tucking one or more of the yarns that are used for forming the blister fabric with at least one stitch or tuck on the dial missing at least one needle on the dial before and/or after this at least one stitch or tuck in the areas where the one or more yarns are not knitting or tucking the design in the front of the fabric on the needles of the cylinder.

In an advantageous method according to the invention, the double jersey knit fabric has a design consisting of more than 36 needles.

In a favourable method according to the invention, the double jersey knit fabric is a knitted mattress ticking.

The purpose of the invention is further achieved by providing a double jersey knit fabric, wherein the double jersey knit fabric is knitted by a method according to the invention.

In the following detailed description, a method for knitting a double jersey knit fabric on a single jacquard, double jersey circular knitting machine according to the state of the art, and furthermore the characteristics and advantages of a method for knitting a double jersey knit fabric on a double jacquard, double jersey circular knitting machine according to the invention, will be further clarified. The intention of this description is only to further explain the general principles of the present invention, therefore nothing in this description may be interpreted as being a restriction of the field of application of the present invention or of the patent rights demanded for in the claims.

BREIF DESCRIPTION OF THE DRAWINGS

Figure 2:
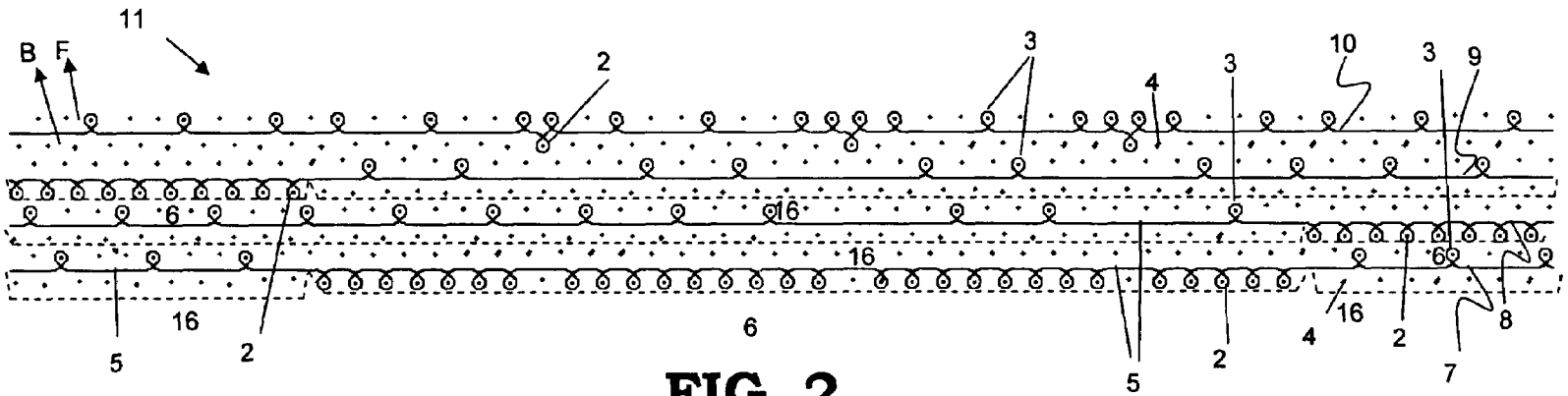
Figure 1:
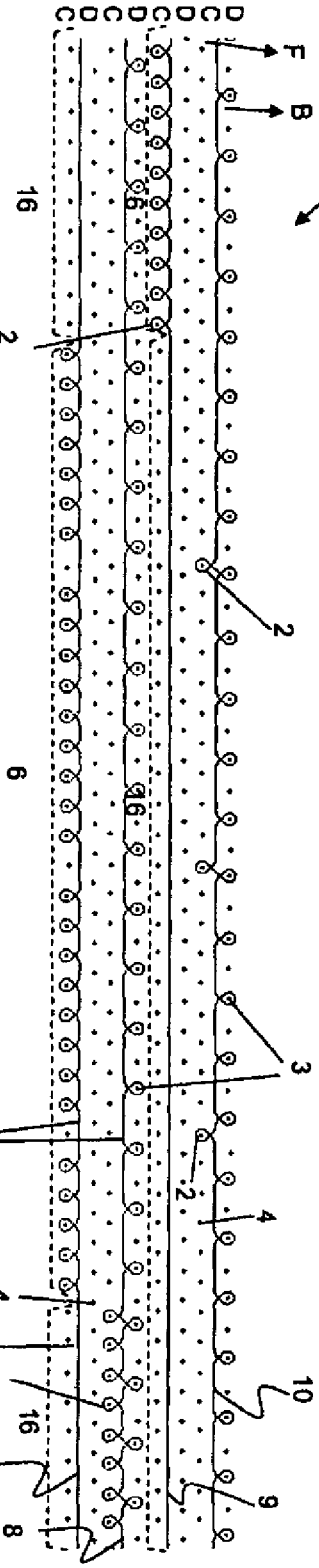
Figure 2:
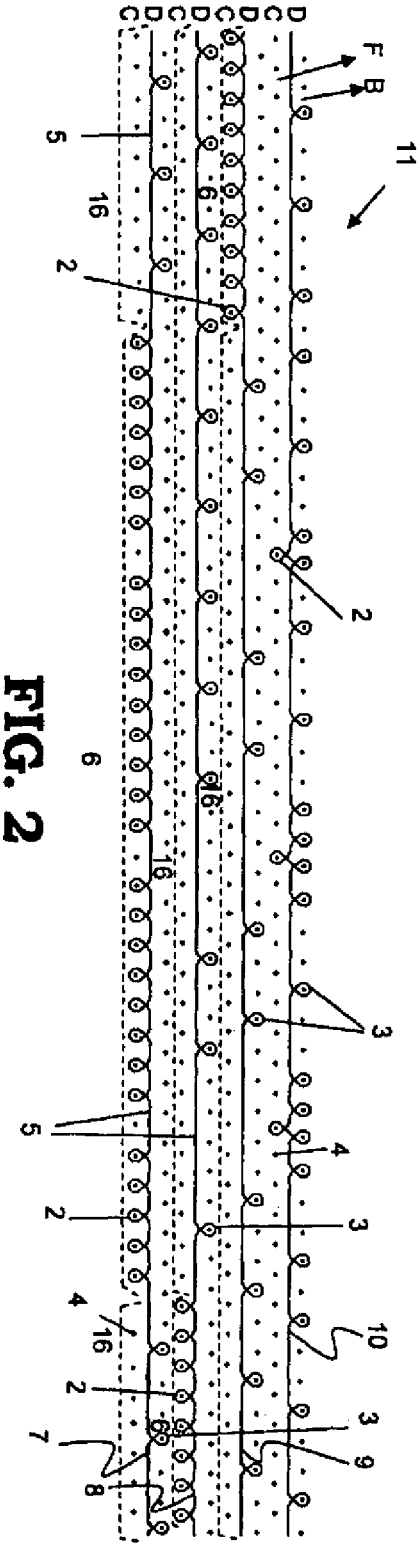

In this description, by means of reference numbers, reference will be made to the attached FIGS. 1 and 2, of which:

FIG. 1 a part of a row of a knitting pattern of an exemplary embodiment of a double jersey knit fabric according to the state of the art that is knitted on a single jacquard double jersey circular knitting machine, and wherein the double jersey knit fabric is build up out of 4 yarns in a different colour is shown;

FIG. 2 a part of a row of a knitting pattern of an exemplary embodiment of a double jersey knit fabric according to the invention that is knitted on a double jersey double jacquard circular knitting machine, and wherein the double jersey knit fabric is build up out of 4 yarns in a different colour is shown.

DETAILED DESCRIPTION OF THE PREFERRED EMBODIMENTS

In both knitting patterns of the double jersey knit fabrics (1, 11) according to the state of the art as shown in FIG. 1, and according to the invention as shown in FIG. 2, a circle downwards (2) is a stitch on the cylinder (C), while a circle upwards (3) is a stitch on the dial (D). It is also possible to knit tucks instead of stitches (2, 3) (not shown on the figure). The points (4) that are shown on FIGS. 1 and 2 are places where no stitch (2, 3) or tuck is knitted, or in other words one or more stitches (2, 3)/tucks are missed on the needles of the cylinder (C) or the dial (D). The lines (5) are yarns (7-10) that are floating between the front (F) and the back (B) of the fabric (1, 11). When in a zone only on the needles of the cylinder (C) or the dial (D) is knitted, a blister fabric (6) (also called a single jersey fabric) is formed.

In the part of the row of a knitting pattern of an exemplary embodiment of a double jersey knit fabric (1) according to the state of the art as shown in FIG. 1 that is knitted on a single jacquard, double jersey circular knitting machine, 4 yarns (7, 8, 9 and 10) are used, i.e.

- a first yarn (7) in the main colour (or background colour) of the front (F) of the fabric (1) that is only knitted on the needles of the cylinder (C) in a knit or tuck and miss combination, thereby creating a zone of blister fabric (6) on the needles of the cylinder (C). In the area (16) where this first yarn (7) is not knitted on the needles of the cylinder (C), this first yarn floats between the front (F) and the back (B) of the fabric (1);
- a second yarn (8) in a second colour of the design that is knitted both on the needles of the cylinder (C) as well on the needles of the dial (D) forming part of the design. In this way, this second yarn (8) also forms a connection between the front (F) and the back (B) of the fabric (1);
- a third yarn (9) in a third colour of the design that is only knitted on the needles of the cylinder (C) in a knit or tuck and miss combination, thereby creating a zone of blister fabric (6) on the needles of the cylinder (C). In the area (16) where this third yarn (9) is not knitted on the needles of the cylinder (C), this third yarn (9) floats between the front and the back of the fabric (1);
- a fourth yarn (8) in a fourth colour of the design that is substantially knitted on the needles of the dial (D) and now and then is knitted on the needles of the cylinder (C) in order to create an extra connection between the front (F) and the back (B) of the fabric (1).

Contrary to the double jersey knit fabric (1) according to the state of the art that is knitted on a single jacquard, double jersey circular knitting machine wherein only the needles of the cylinder (C) are controlled by an electronical pattern controlling mechanism, the double jersey knit fabric (11) according to the invention is knitted on a double jacquard, double jersey circular knitting machine wherein both the needles of the cylinder (C) as well as the needles of the dial (D) are controlled by an electronical pattern controlling mechanism. The double jersey knit fabric (11) according to the invention is knitted on this double jacquard, double jersey circular knitting machine in such a way that it has a desired "aesthetical" design on the front (F) of the fabric (11), and has a technical design on the back (B) of the fabric (11), the sole purpose of this technical design being to tie down the yarns (7, 8, 9) that are used for forming the blister fabric (11) in the areas where they are floating over a long distance between the front (F) and the back (B) of the fabric (11). This technical design is created by knitting or tucking one or more of the yarns (7, 8, 9 and/or 10) that are used for forming the blister fabric (6) with at least one stitch (3) solely on the needles of the dial (D), missing at least one needle on the dial (D) before and/or after this at least one stitch (3) in the areas (16) where the one or more yarns (7, 8, 9 and/or 10) are not knitting or tucking the design of the front (F) of the fabric (11). This can also clearly be seen in the part of the row of a knitting pattern of an exemplary embodiment of a double jersey knit fabric (11) according to the invention as shown in FIG. 2.

By using such a double jacquard, double jersey circular knitting machine, it is possible to use all yarns (7-10) for knitting blister fabric (6) on the needles of the cylinder (C) of the knitting machine. In the areas (16) where these yarns (7-10) are not knitting or tucking the design in the front (F) of the fabric (11) on the needles of the cylinder (C), these yarns (7-10) are knitted or tucked with at least one stitch (3) or tuck solely on the needles of the dial (D), missing at least one needle on the dial (D) before and/or after this at least one stitch (3) or tuck.

In the double jersey knit fabric (11) according to the invention as shown on FIG. 2, the 4 yarns (7-10) are then provided in the following way:

the first yarn (7) in the main colour (or background colour) of the front (F) of the fabric (1) that in FIG. 1 only is knitted on the needles of the cylinder (C) in a knit (can also be a tuck) and miss combination, thereby creating a zone of blister fabric (6) on the needles of the cylinder (C), in the area (16) where it is floating between the front (F) and the back (B) of the fabric (1), is according to the invention as can be seen in FIG. 2, solely and repetitively knitted (can also be tucked) with one stitch (3) (can also be a tuck) on the needles of the dial (D), missing two stitches (3) (can also be tucks) on the needles of the dial (D) However, also another number of stitches (3) or tucks can be knitted.;

the second yarn (8) in the second colour of the design that in FIG. 1 is knitted both on the needles of the cylinder (C) as well on the needles of the dial (D) forming part of the design, is in FIG. 2 used for forming a blister fabric (6). In the area (16) where this second yarn (8) is not knitting or tucking the design in the front (F) of the fabric (1) on the needles of the cylinder (C), and as can be seen in FIG. 1 was floating between the front (F) and the back (B) of the fabric (1), in FIG. 2 now is solely knitted (can also be tucked) with one stitch (3) (can also be a tuck) on the needles of the dial (D), missing a different number of stitches (3) (can also be tucks) on the needles of the dial (D). However, also another number of stitches (3) or tucks can be knitted;

the third yarn (9) in the third colour of the design that is only knitted on the needles of the cylinder (C) in a knit (can also be a tuck) and miss combination, thereby creating a zone of blister fabric (6) on the needles of the cylinder (C), in the area (16) where in FIG. 1 this yarn (7) is not knitting or tucking the design in the front (F) of the fabric (1) on the needles of the cylinder (C), and as can be seen in FIG. 1 is floating between the front (F) and the back (B) of the fabric (1), in FIG. 2 this third yarn (9) now is solely knitted (can also be tucked) with one stitch (3) (can also be a tuck) on the needles of the dial (D), missing a different number of stitches (3) (can also be tucks) before and/or after this one stitch. However, also another number of stitches (3) or tucks can be knitted.;

a fourth yarn (10) in the fourth colour of the design that is substantially knitted on the needles of the dial (D) and now and then is knitted on the needles of the cylinder (C) in order to create an extra connection between the front (F) and the back (B) of the fabric (1) remains substantially unchanged.

It has to be remarked that in FIG. 2, only a part of a row of a knitting pattern of an exemplary embodiment of a double jersey knit fabric according to the invention that is knitted on a double jersey double jacquard circular knitting machine, and wherein the double jersey knit fabric is build up out of 4 yarns in a different colour is shown.

It should be clear that the yarns (7-9) that are shown in the part of the row of the knitting pattern as shown in FIG. 2 and that are used for knitting the blister fabric (6) can be tied down on the dial (D) by knitting these yarns (7-9) with another number of stitches (3) or tucks on the dial (D) missing another number of needles on the dial (D), this in a repetitively or non-repetitively manner.

It should furthermore be clear that, when it is desired, it still stays possible to knit certain areas of the jersey knit fabric (11) in the classical way, i.e. by forming a binding/liaison between the front (F) and the back (B) of the fabric, thus knitting one or more yarns (7, 8, 9, 10) on the needles of the cylinder (C) as well as on the needles of the dial (D) of the double jacquard, double jersey circular knitting machine (not shown on FIG. 1 or 2).

It is furthermore possible to use a lay-in yarn (not shown on the figures) to add lay-in yarns in-between the needles of the cylinder (C) and the dial (D), in order to give volume to these double jersey knit fabrics (11).

In the design of the double jersey knit fabric (11), it is also possible to use more or less colours.

With this new method according to the invention, it is also possible not to use the fourth yarn (10), and to use only three yarns, i.e. the first, second and third yarn (7, 8 and 9), wherein all three yarns (7, 8 and 9) are forming blister and are also used to form a connection between the front (F) and the back (B) of the fabric (11).

The knitting pattern of a jersey knitting fabric (11) according to the invention (as shown in FIG. 2) consists of approximately 2200 to 2400 needles. The pattern of this fabric (11) can be build up out of a repetitive design, but can also be build up out of one single design (also called "all over design").

This method according to the invention wherein a non-reversible, single-sided designed double jersey knit fabric (11) is obtained is particularly suitable for knitting double jersey mattress ticking, since for mattress ticking only the front (F) of the fabric (11) is visible with the eye, and not the back (B) of the fabric (11), consequently being of no importance.

The invention claimed is:

1. Method for knitting a double jersey knit fabric (11) on a double jacquard, double jersey circular knitting machine, the double jersey knit fabric (11) having a design consisting of more than 12 needles, wherein the knitting comprises knitting with a machine comprising a cylinder (C) and a dial (D) provided with a plurality of needles, driving each of the needles separately by an electronic pattern controlling mechanism, knitting a front (F) of the fabric (11) with the needles of the cylinder (C), and knitting a back (B) of the fabric (11) with the needles of the dial (D), and forming with one or more yarns at least one area of a blister fabric (6) in the design of the front (F) of the fabric (11), knitting a non-reversible single-sided designed knit fabric (11) having a desired design at the front of the fabric (11) and a technical design at the back of the fabric (11), and creating the technical design by knitting or tucking the one or more yarns (7, 8, 9, 10) forming the blister fabric (6) with at least one stitch (3) or tuck solely on the needles of the dial (D), missing at least one needle on the dial (D) in areas (16) where the one or more yarns (7, 8, 9, 10) are not knitting or tucking the design in the front (F) of the fabric (11) on the needles of the cylinder (C).

2. Method according to claim 1, further comprising creating the technical design by knitting or tucking all the yarns (7, 8, 9, 10) forming the blister fabric (6) with at least one stitch (3) or tuck solely on the dial (D), missing at least one needle on the dial (D) in the areas (16) where the one or more yarns (7, 8, 9, 10) are not knitting or tucking the design in the front (F) of the fabric (11) on the needles of the cylinder (C).

3. Method according to claim 1, further comprising creating the technical design by repetitively knitting or tucking one or more of the yarns (7, 8, 9, 10) forming the blister fabric (6) with at least one stitch (3) or tuck solely on the dial (D), missing at least one needle on the dial (D) in the areas (16) where the one or more yarns (7, 8, 9, 10) are not knitting or tucking the design in the front (F) of the fabric (11) on the needles of the cylinder (C).

4. Method according to claim 1, wherein the double jersey knit fabric (11) has a design consisting of more than 36 needles.

5. Method according to claim 1, wherein the double jersey knit fabric (11) is a knitted mattress ticking.

6. Double jersey knit fabric, wherein the double jersey knit fabric (11) is knitted by a method according to claim 1.

7. The method of claim 1, wherein the missing at least one needle on the dial (D) comprises missing at least one needle on the dial (D) before the at least one stitch (3) or tuck in the areas (16) where the one or more yarns (7, 8, 9, 10) are not knitting or tucking the design in the front (F) of the fabric (11) on the needles of the cylinder (C).

8. The method of claim 1, wherein the missing at least one needle on the dial (D) comprises missing at least one needle on the dial (D) after the at least one stitch (3) or tuck in the areas (16) where the one or more yarns (7, 8, 9, 10) are not knitting or tucking the design in the front (F) of the fabric (11) on the needles of the cylinder (C).

9. The method of claim 1, wherein the missing at least one needle on the dial (D) comprises missing at least one needle on the dial (D) before and after the at least one stitch (3) or tuck in the areas (16) where the one or more yarns (7, 8, 9, 10) are not knitting or tucking the design in the front (F) of the fabric (11) on the needles of the cylinder (C).

10. The method of claim 2, wherein the missing at least one needle on the dial (D) comprises missing at least one needle on the dial (D) before the at least one stitch (3) or tuck in the areas (16) where the one or more yarns (7, 8, 9, 10) are not knitting or tucking the design in the front (F) of the fabric (11) on the needles of the cylinder (C).

11. The method of claim 2, wherein the missing at least one needle on the dial (D) comprises missing at least one needle on the dial (D) after the at least one stitch (3) or tuck in the areas (16) where the one or more yarns (7, 8, 9, 10) are not knitting or tucking the design in the front (F) of the fabric (11) on the needles of the cylinder (C).

12. The method of claim 2, wherein the missing at least one needle on the dial (D) comprises missing at least one needle on the dial (D) before and after the at least one stitch (3) or tuck in the areas (16) where the one or more yarns (7, 8, 9, 10) are not knitting or tucking the design in the front (F) of the fabric (11) on the needles of the cylinder (C).

13. The method of claim 3, wherein the missing at least one needle on the dial (D) comprises missing at least one needle on the dial (D) before the at least one stitch (3) or tuck in the areas (16) where the one or more yarns (7, 8, 9, 10) are not knitting or tucking the design in the front (F) of the fabric (11) on the needles of the cylinder (C).

14. The method of claim 3, wherein the missing at least one needle on the dial (D) comprises missing at least one needle on the dial (D) after the at least one stitch (3) or tuck in the areas (16) where the one or more yarns (7, 8, 9, 10) are not knitting or tucking the design in the front (F) of the fabric (11) on the needles of the cylinder (C).

15. The method of claim 3, wherein the missing at least one needle on the dial (D) comprises missing at least one needle on the dial (D) before and after the at least one stitch (3) or tuck in the areas (16) where the one or more yarns (7, 8, 9, 10) are not knitting or tucking the design in the front (F) of the fabric (11) on the needles of the cylinder (C).

* * * * *

UNITED STATES PATENT AND TRADEMARK OFFICE

CERTIFICATE OF CORRECTION

PATENT NO. : 7,536,879 B2
APPLICATION NO. : 12/072531
DATED : May 26, 2009
INVENTOR(S) : Johan Vanwelden It is certified that error appears in the above-identified patent and that said Letters Patent is hereby corrected as shown below:

The title page should be deleted and substitute therefor the attached title page.

In the Drawings

Replace Figures 1 and 2 with the attached correct formal drawings.

Signed and Sealed this

Twenty-first Day of July, 2009

John Doll

JOHN DOLL
*Acting Director of the United States Patent and Trademark Office*

(12) United States Patent
Vanwelden

(10) Patent No.: US 7,536,879 B2
(45) Date of Patent: May 26, 2009

(54) METHOD FOR KNITTING A DOUBLE JERSEY KNIT FABRIC ON A DOUBLE JACQUARD, DOUBLE JERSEY CIRCULAR KNITTING MACHINE AND DOUBLE JERSEY KNIT FABRIC KNITTED BY SUCH A METHOD

(75) Inventor: Johan Vanwelden, Wielsbeke (BE)

(73) Assignee: Lava bvba, Wielsbeke (BE)

( * ) Notice: Subject to any disclaimer, the term of this patent is extended or adjusted under 35 U.S.C. 154(b) by 0 days.

(21) Appl. No.: 12/072,531

(22) Filed: Feb. 27, 2008

(65) Prior Publication Data

US 2008/0236204 A1 Oct. 2, 2008

(30) Foreign Application Priority Data

Mar. 27, 2007 (EP) ..... 07105064

(51) Int. Cl.
*D04B 9/06* (2006.01)

(52) U.S. Cl. ..... 66/196; 66/19

(58) Field of Classification Search ..... 66/92, 66/93, 94, 8, 194

See application file for complete search history.

(56) References Cited

U.S. PATENT DOCUMENTS

| | | | | |
|---|---|---|---|---|
| 3,986,374 | A * | 10/1976 | Fane | 66/190 |
| 3,990,268 | A * | 11/1976 | Smith | 66/92 |
| 4,353,229 | A * | 10/1982 | Hutchinson et al. | 66/197 |
| 5,027,618 | A * | 7/1991 | Robinson et al. | 66/202 |
| 5,887,451 | A * | 3/1999 | Suzuki | 66/64 |

FOREIGN PATENT DOCUMENTS

| | | |
|---|---|---|
| DE | 2253005 | 5/1973 |
| EP | 0591987 | 7/1997 |
| EP | 0737767 | 1/2000 |
| EP | 0822280 | 6/2002 |
| FR | 2160131 | 6/1973 |

* cited by examiner

*Primary Examiner*—Danny Worrell
(74) *Attorney, Agent, or Firm*—James Creighton Wray; Meera P. Narasimhan

(57) ABSTRACT

The invention relates to a method for knitting a double jersey knit fabric (11) on a double jacquard, double jersey circular knitting machine, the double jersey knit fabric (11) having a design consisting of more than 12 needles, wherein the knitting machine comprises a cylinder (C) and a dial (D) provided with needles each separately driven by an electronical pattern controlling mechanism, wherein the needles of the cylinder (C) are provided for knitting the front (F) of the fabric (11), and the needles of the dial (D) are provided for knitting the back (B) of the fabric, and wherein the front (F) of the fabric (11) comprises at least one area of blister fabric (5), wherein a non-reversible single-sided designed knit fabric (11) is knitted having a desired design at the front of the fabric (11) and a technical design at the back of the fabric (11), wherein this technical design is created by knitting or tucking one or more of the yarns (7, 8, 9 and/or 10) that are used for forming the blister fabric (6) with at least one stitch (3) or tuck solely on the needles of the dial (D), missing at least one needle on the dial (D) before and/or after this at least one stitch (3) or tuck in the areas (16) where the one or more yarns (7, 8, 9 and/or 10) are not knitting or tucking the design in the front (F) of the fabric (11) on the needles of the cylinder (C). The invention further relates to a double jersey knit fabric (11) knitted by such a method.

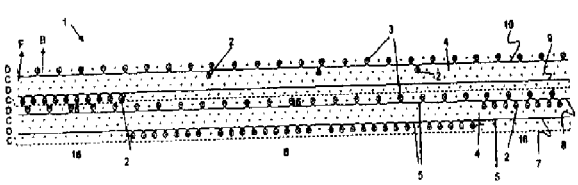

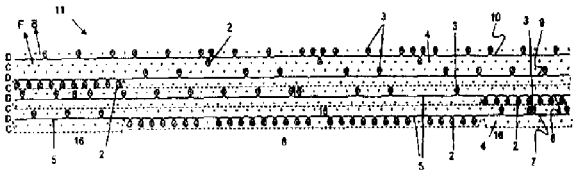

15 Claims, 1 Drawing Sheet